US005951190A

United States Patent [19]

Wilson

[11] Patent Number: 5,951,190

[45] Date of Patent: Sep. 14, 1999

[54] POCKET LOOSE-LEAF BINDER

[75] Inventor: Robert B. Wilson, South Hadley, Mass.

[73] Assignee: Specialty Loose Leaf, Inc., Holyoke, Mass.

[21] Appl. No.: 08/968,755

[22] Filed: Aug. 1, 1997

Related U.S. Application Data

[60] Provisional application No. 60/023,422, Aug. 16, 1996.

[51] Int. Cl.[6] ..... B42F 13/00

[52] U.S. Cl. ..... 402/73; 281/19.1; 281/29; 281/31; 402/70

[58] Field of Search ..... 281/19.1, 29, 31, 281/37; 402/70, 73, 78

[56] References Cited

U.S. PATENT DOCUMENTS

| | | | |
|---|---|---|---|
| 3,169,029 | 2/1965 | Margolis | 281/29 |
| 4,301,962 | 11/1981 | Monckton et al. | 229/72 |
| 4,420,112 | 12/1983 | Cline | 281/31 |
| 4,519,629 | 5/1985 | Podosek | 281/25 A |
| 4,552,479 | 11/1985 | Nickow et al. | 281/31 |
| 4,629,349 | 12/1986 | Pitts | 402/74 |
| 5,411,293 | 5/1995 | Monzyk | 281/31 |
| 5,417,509 | 5/1995 | Schwartz | 402/79 |
| 5,445,417 | 8/1995 | Bromer et al. | 281/46 |
| 5,472,237 | 12/1995 | Rajeswaran | 281/19.1 |
| 5,660,514 | 8/1997 | Wilson | 281/29 |

*Primary Examiner*—Willmon Fridie, Jr.
*Assistant Examiner*—Monica Smith
*Attorney, Agent, or Firm*—Robert A. Seemann

[57] ABSTRACT

A die-cut sheet of material is folded in three and clamped by a ring binder mechanism so that two panels formed by the folding are pressed to a third panel that is between the folds, forming a binder cover leaf on each side of the mechanism. The ends of the folded panels are spaced from the fold lines, and may be fastened together to form a horizontal pocket, a vertical pocket, or horizontal and vertical pockets in both leafs.

11 Claims, 6 Drawing Sheets

POCKET LOOSE-LEAF BINDER

This application claims the benefit of U.S. Provisional Application No. 60/023,422, filed Aug. 16 1996.

BACKGROUND OF THE INVENTION

This invention pertains to loose-leaf binders, more particularly to a binder cover made from a single die-cut sheet of material, having a front leaf, a back leaf, and a first pair of pockets one on each leaf, which openings are in opposite directions when the cover is laid flat open. The binder cover may also have a second pair of pockets, which open laterally to the openings of the first pair of pockets, with no further die cutting of the sheet.

The field of loose-leaf binders is replete with designs for making covers having leaf pockets.

Many of the designs have two sheets of paper or plastic laminated or bonded together around two or three edges of the sheets to form pockets open at one or more of the edges, and slits through one or more of the sheets to form additional pockets by accessing the space between the sheets through the slits.

Other designs have a single sheet folded in half whereby the fold is one edge of the cover comprising the facing halves, and the halves are bonded along the opposite edge or any two of the three edges of the folded halves. In some designs an edge of one of the halves has one or more narrow tabs, or one tab that extends along the edge. The tab is glued to the edge of the other sheet. A tab is preferred because without a tab, papers inserted into the pocket tend to wedge between the glued edges.

Whether or not a tab is included, for aesthetic quality and maximum strength, care must be taken to fold the halves accurately so that the edges coincide. This arrangement is slow and labor intensive, or requires costly machinery maintained to tight tolerances.

SUMMARY OF THE INVENTION

It is one object of the invention to provide a binder cover having a front leaf, a back leaf, and a first pair of pockets, one on each leaf.

It is another object that the binder cover is made from a single die-cut sheet of material.

It is another object that the first pair of pockets open in opposite directions when the cover is laid flat.

It is another object that the binder cover has a third pocket having an opening that is transverse to the openings of the first pair of pockets, with no further die-cutting of the sheet for the third pocket.

It is another object of the invention that the pair of openings are at the ends of a tube of the single sheet of die-cut material, made by the sheet being folded back upon itself on a pair of parallel folds, forming a back panel and two front panels having two edges of the front panels bonded together, the bond being spaced from each of the two folds and being on a line that is lateral to and intersects the pair of openings.

It is another object that the parallel edges of the front panels need not be bonded in order for the pockets to be able to hold sheets of paper, as the front panels and their adjacent edges extend from the fold over the face of each leaf sufficiently to contain sheets of paper in the pockets.

It is another object that the cover can be made at high speed and to a broad tolerance while providing a neat edge appearance to the finished product.

It is another object that the third pocket opens toward one of the two edges which are bonded together.

It is another object that the tube can be made continuously from a roll of strip material, the strip being drawn from the roll and rolled longitudinally axis lengthwise to form the tube, the prefold top and bottom edges of the strip being bonded on an anvil that is spaced from the predetermined fold lines of the tube, and the tube being flattened to form front and back leafs of the cover and cut to form the first and second openings, and that a paper holding apparatus be mounted on the tube by fasteners passing through the front and back leafs.

A die-cut sheet of material includes a first panel, a second panel folded over the first panel along a first fold line and having a first end distal from the first fold line, a third panel folded over the first panel along a second fold line and having a second end distal from the second fold line.

A device for temporarily holding sheets of paper, is mounted on the second and third panels, and includes means for fastening the second and third panels to the first panel.

The first and second ends are in contact with one another spaced from each of the first and second fold lines, and the first panel and second panel form a pocket between them.

The binder can be made from a variety of materials including but not limited to various weights and thicknesses of board, paper, poly and cloth.

One version of the binder includes an extended flap which locks the binder in a closed position while keeping items in the pockets from falling out.

BRIEF DESCRIPTION OF THE DRAWINGS

In order that the invention be more fully comprehended, it will now be described, by way of example, with reference to the accompanying drawings, in which.

DESCRIPTION OF THE PREFERRED EMBODIMENTS

Figure 1:
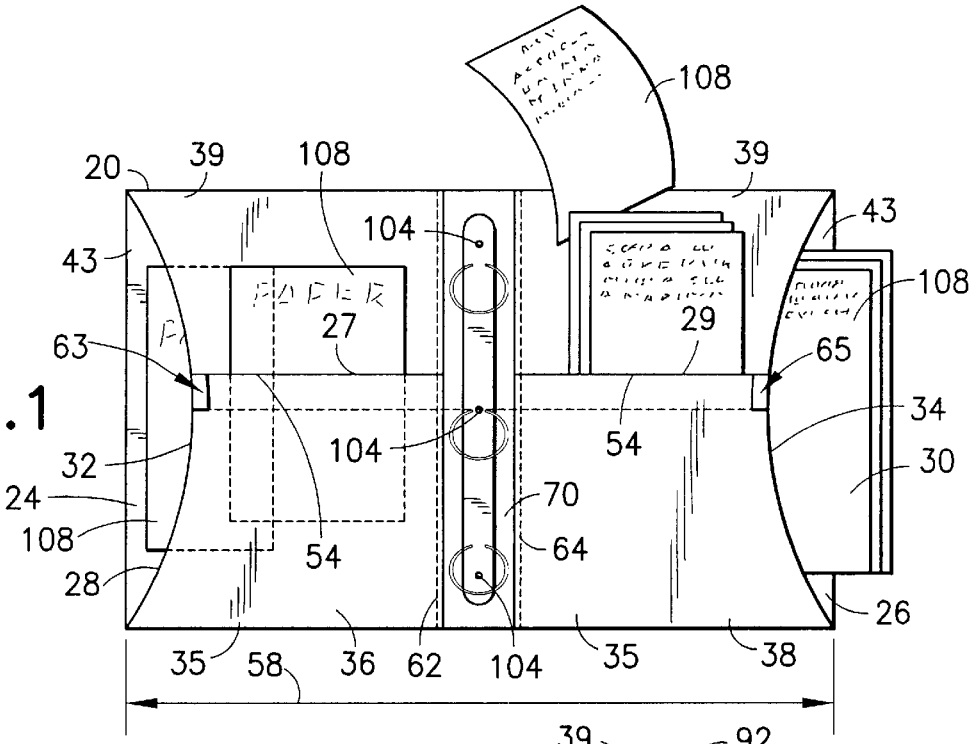
FIG. 1 is a schematic view of a binder of the present invention, in the open position.
Figure 2:
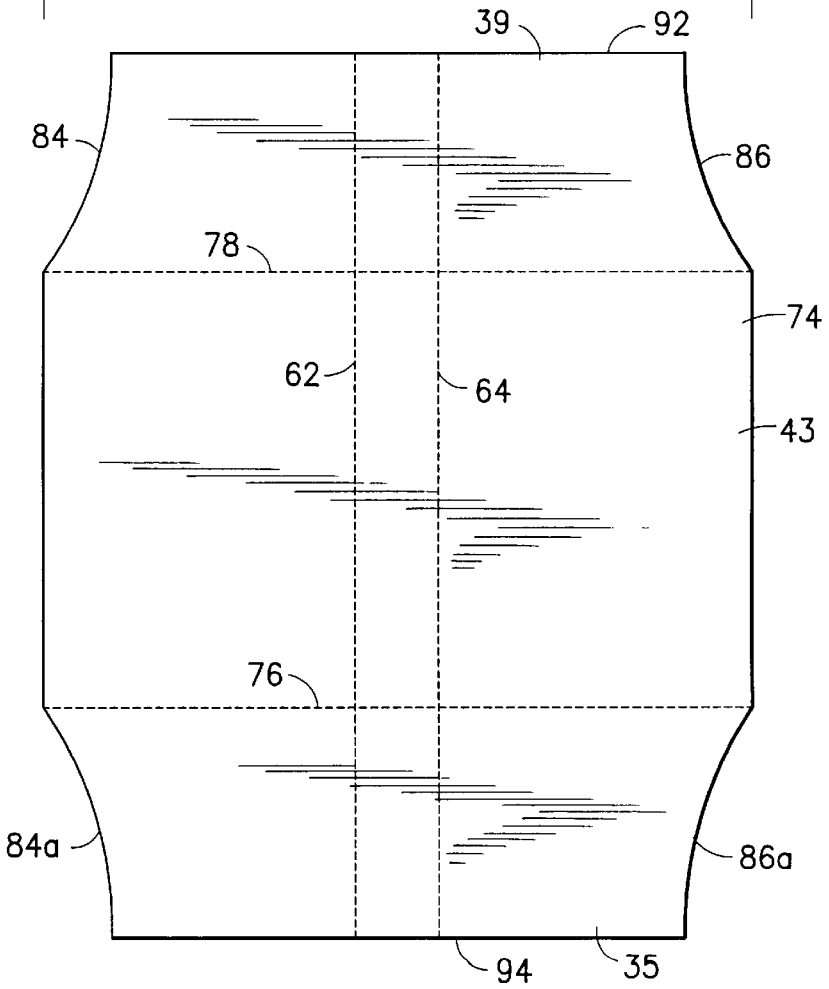
FIG. 2 is a front view of a piece of material, die cut and scored prior to being folded to make the binder of FIG. 1.
Figure 3:
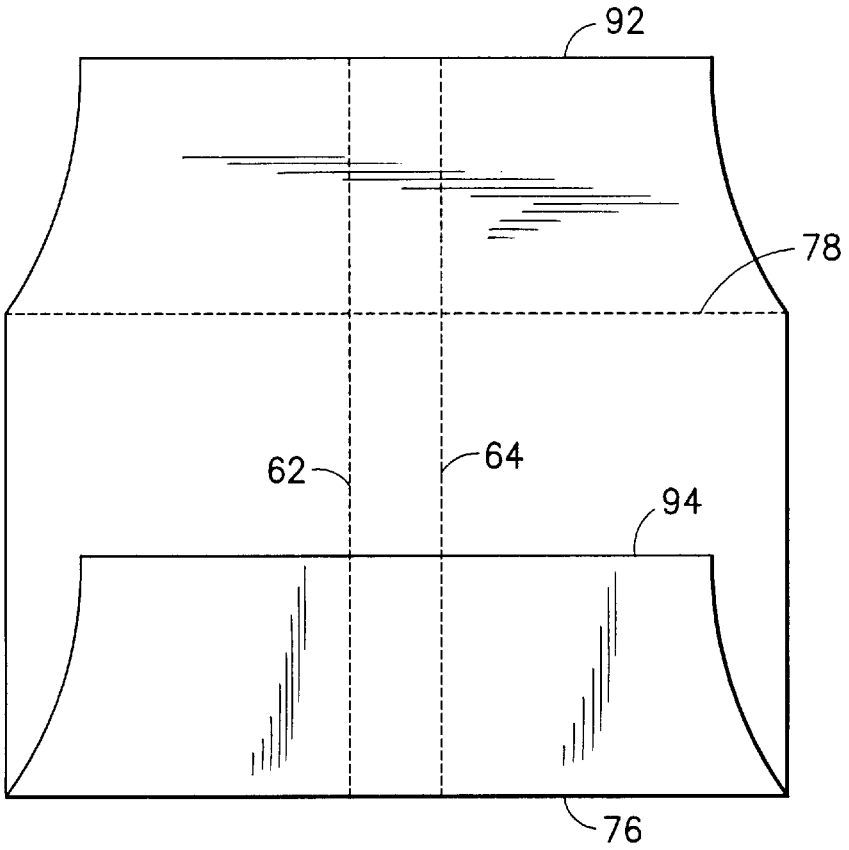
FIG. 3 is a front view of the die cut material of FIG. 2 with the bottom panel folded up.
Figure 4:
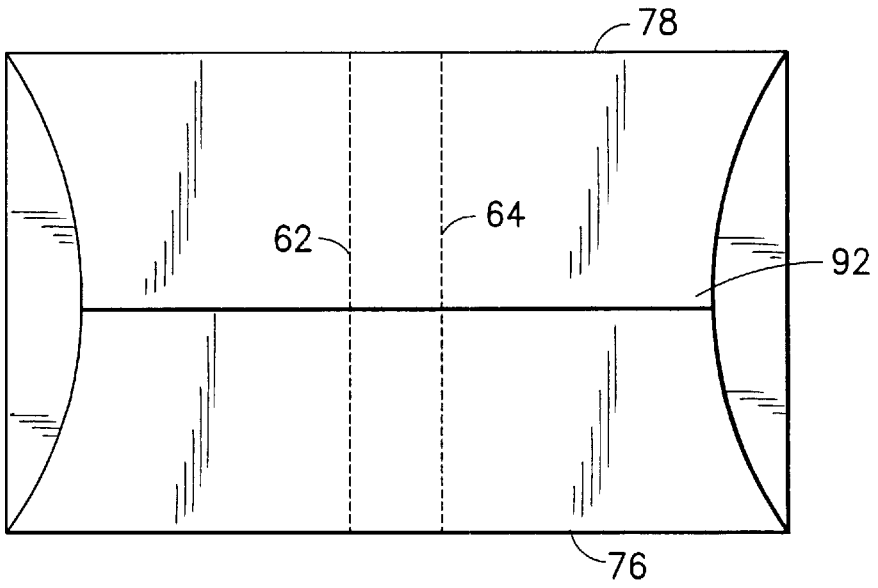
FIG. 4 is a front view of the die cut material of FIG. 2 with the top panel folded down to overlap the bottom panel.
Figure 5:
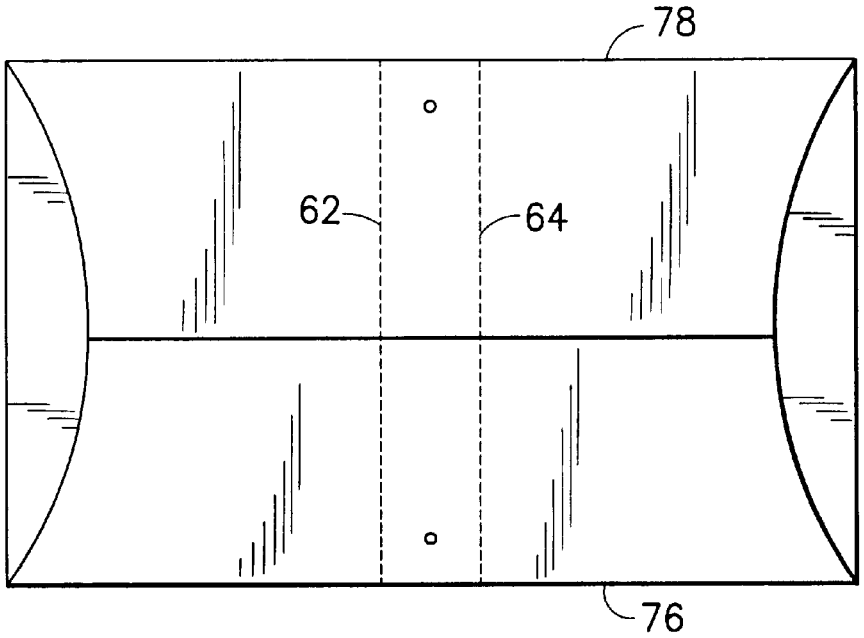
FIG. 5 is a front view of the folded die cut material of FIG. 4 punched to receive the ring mechanism fasteners.
Figure 6:
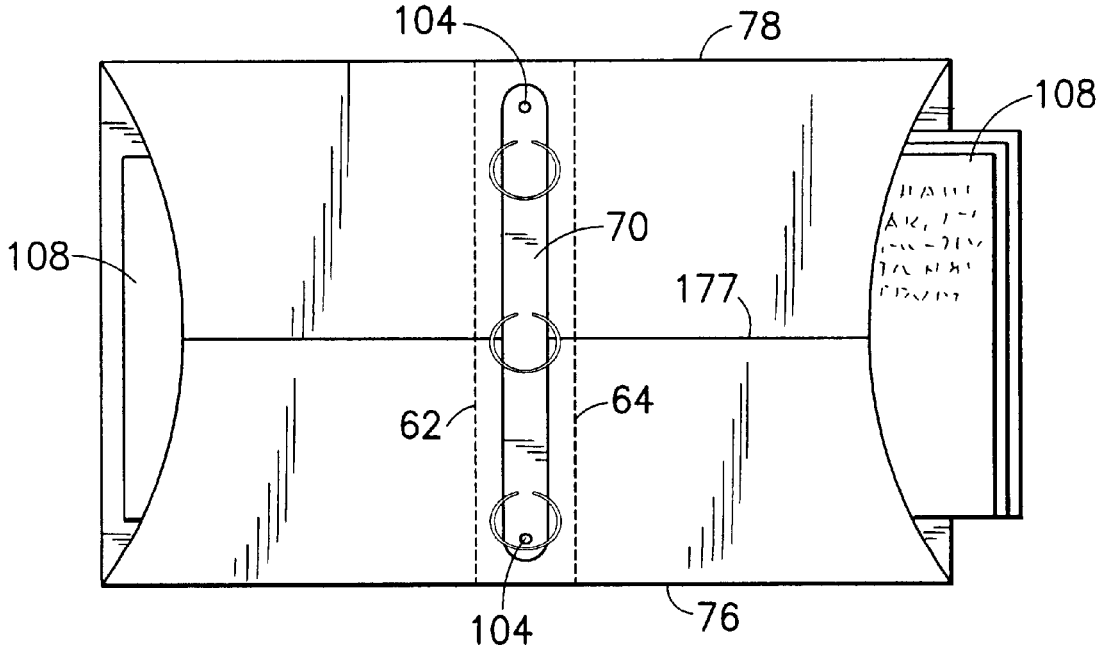
FIG. 6 is a front view of the completed product of FIGS. 1–5, with papers being stored in the pockets.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

In FIG. 1, binder 20 includes pocket 24 and 26. The pockets have forward facing openings 28, 30 at front margins 32, 34 of covers 36, 38.

Seam 54 extends the length 58 of cover 20 from margin 32 to margin 34.

The binder folds closed on fold lines 62, 64 about binder mechanism 70.

Papers can be inserted in pockets 24, 26, 27, and 29.

Referring further to FIGS. 1–6, die cut sheet 74 has fold lines 62, 64 and 76, 78. Curves 84, 84*a,* form margin 32, and curves and 86, 86*a* form margin 34 when sheet 74 is folded on fold lines 76 and 78 so that end 94 of panel 35 overlaps end 92 of panel 39 on the front of binder 20. Either end 92, 94 may be chosen to overlap the other.

The strip of overlaped ends and seam 54 are spaced from fold lines 76 and 78.

Ends 92, 94 are preferably bonded continuously, so that pockets 24 and 26 are provided.

Ends 92, 94, however, may just be bonded by spot fastening means 63 so that pockets 27 and 29 are provided in addition to pockets 24 and 26.

The folded tube may be made relatively flat by way of the folds on lines 76 and 78, or the folded tube may be pressed flat by rivets 104 of loose-leaf binder mechanism 70 after folding.

Binder mechanism 70 is fastened to the folded tube by rivets 104 or other means. The fastened assembly of the binder mechanism to the folded tube closes the pockets' bottoms which are adjacent to the binder mechanism.

The sheet folds over continuously at the top and bottom of the cover from panel 43 to panels 35 and 39, and panels 35 and 39 extend over panel 43 far enough from the folds to hold large sheets of paper 108 in pockets 24 and 26 when panels 35 and 39 are pressed to back panel 43 other under the ring binder mechanism. The pockets are able to hold the sheets of paper without bonding of ends 92 and 94 together with only moderately stiff sheet material sheet 74.

In a preferred embodiment, the die cut material is chosen so that fastening of the binder assembly pinches the folded tube so that the bottoms of the pockets end at fold line 62 and 64 so that paper sheets 108 placed in the pockets do not interfere with folding the covers together.

In another embodiment, the die cut material is chosen, to be more pliant for example, so that papers are allowed to extend into the pocket past fold lines 62 and 64 so that the folds grip papers contained in the pockets when the covers are closed.

Figure 7:
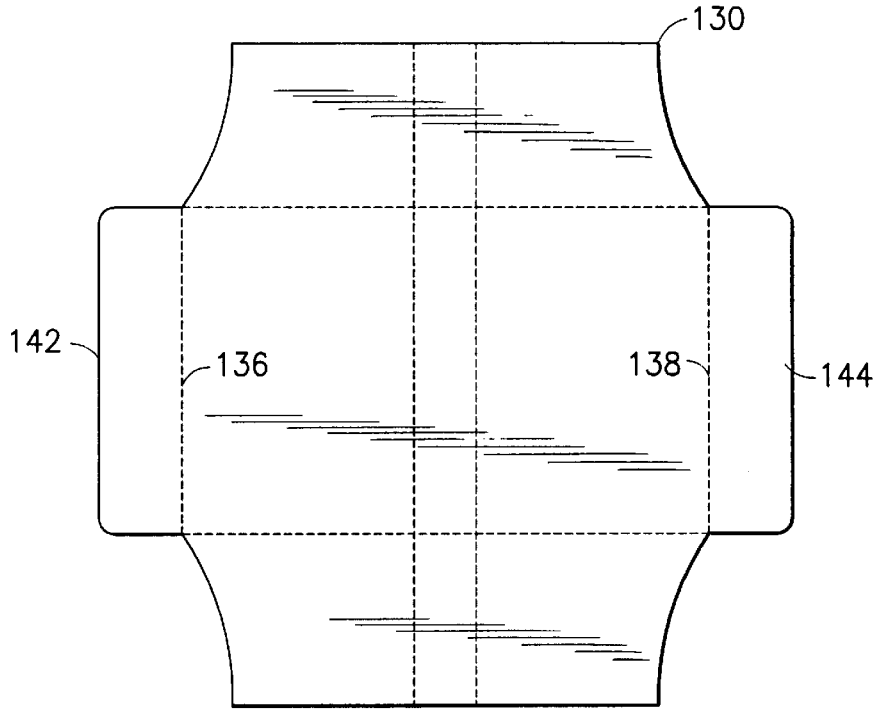
FIG. 7 is a front view of a die cut sheet of another binder of the present invention.

In FIG. 7, die cut sheet 130 has additional fold lines 136, 138 for folding panels 142, 144 over the pocket openings and the front of the covers of the binder. The binder is made from the die cut sheet and binder mechanism as described above.

Figure 8:
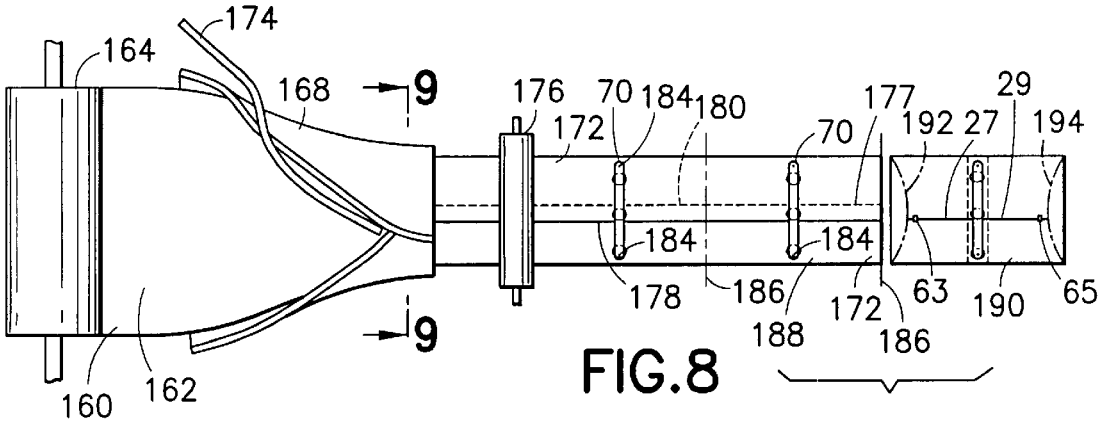
FIG. 8 is a schematic view of binders being made according to the invention.
Figure 9:
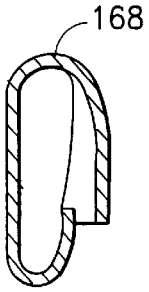
FIG. 9 is a cross section view of the fold-funnel of FIG. 8 taken along 9—9.

Referring to FIGS. 8 and 9, binder material 160 is provided in an elongated strip 162 wound on a roller 164. Binder material 160 is fed through fold-funnel 168 which folds it into a continuous elongated tube 172 which is drawn through the fold-funnel and flattened by roller 176. Glue is fed by tube 174 to seam 177 of fold ends 178, 180 to bond the seam. The glue feed can be continuous to bond the seam continuously, or the glue feed can be pulsed to make spot seals 63 and 65 to form pockets 27 and 29.

Loose-leaf mechanism 70 is fastened to the tube by rivets 184 or other means which clamp the tube closed. Lines 186 are cut lines of the tube which results in separated binders 188, 190.

Curves 192, 194 are cut from the front facing sides of the covers of binder 190.

Figure 10:
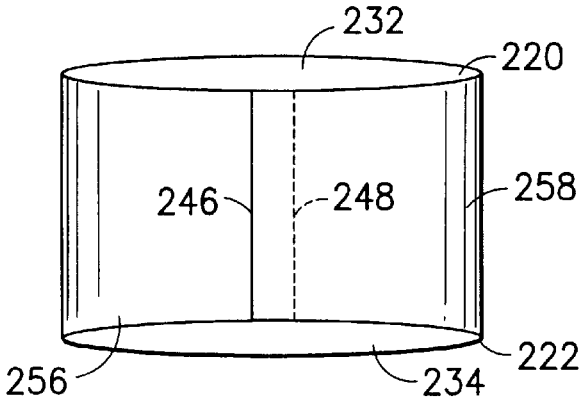
FIG. 10 is a front view of a tube of another binder of the invention.
Figure 11:
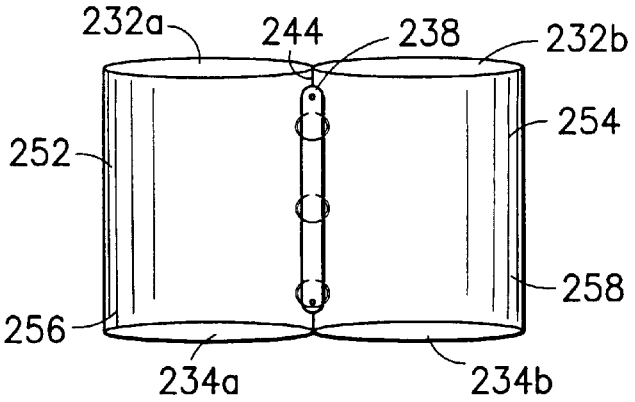
FIG. 11 is a front view of the tube of FIG. 10 with a binder mechanism.

Referring to FIGS. 10, and 11, die cut sheet 220 is folded into tube 222 having openings 232 and 234. Binder mechanism 238 is fastened to tube 222 longitudinally with seam 244 of ends 246 and 248 of panels 256 and 258 of sheet 220, so that the tube is Clamped closed along the seam. This provides two longitudinal pockets 252 and 254 having openings 232*a,* 232*b,* 234*a,* and 234*b.*

Figure 12:
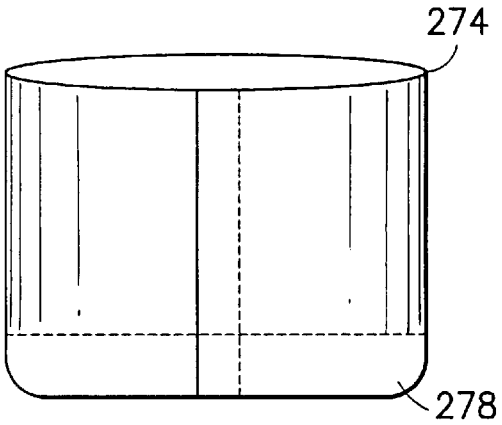
FIG. 12 is a front view of a tube of another binder of the invention.
Figure 13:
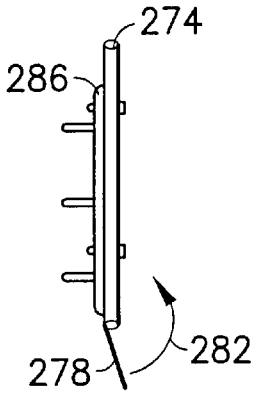
FIG. 13 is a right side view of the tube of FIG. 12 with a binder mechanism.

In FIGS. 12 and 13, tube 274 has extended panel 278 which can be folded 282 behind the flattened tube in order to seal the longitudinal pocket openings at one end of the longitudinal pockets formed when tube 274 is clamped by binder mechanism 286. Although panel 278 extends from the front of the tube in FIG. 12, it may be made to extend from the back of the tube. It would then be folded over the front of the tube before the binder mechanism is mounted on the tube, or it may be cut so that it does not interfere with the binder mechanism when it is folded over the front of the tube.

Figure 14:
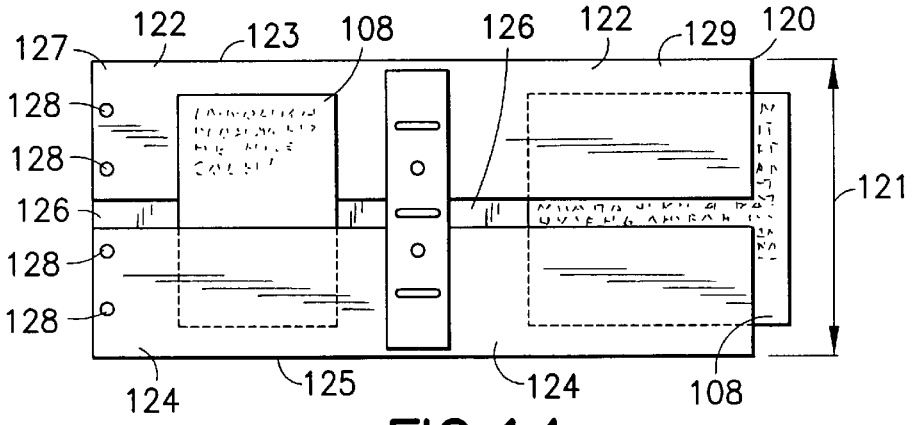
FIG. 14 is a front view of a binder of the invention.

In FIG. 14, panels 122 and 124 of binder 120 are folded over panel 126 on fold lines 123 and 125 respectively, and spaced from one another. Panel 124 extends from fold line 125 over panel 126 least ⅓ the distance 121 of panel 126 between lines 123 and 125. Panels 122 and 124 are bonded 128 to panel 126 at their distal ends of leaf 127, and are not so bonded at their distal ends of leaf 129. Panels 122 and 124 so configured can hold paper sheets between them and panel 126 vertically in the bonded leaf and both horizontally and vertically in the non-bonded leaf.

Figure 15:
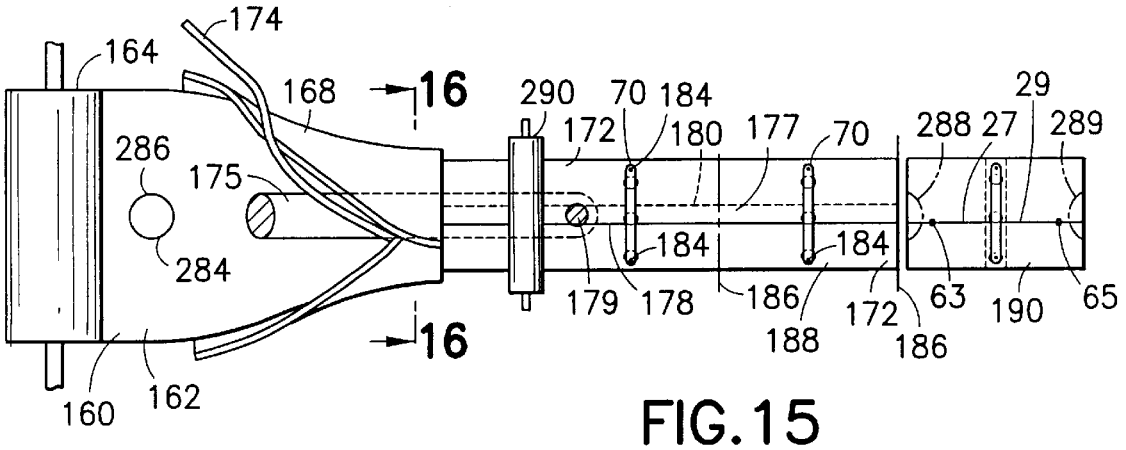
FIG. 15 is a schematic view of a binder being made according to the invention.
Figure 16:
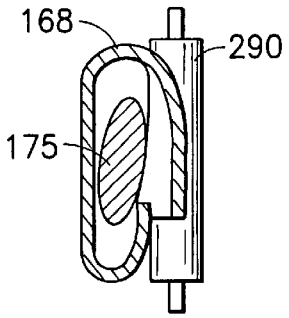
FIG. 16 is a cross section view of the fold-funnel of FIG. 15 taken along 16—16.

Referring to FIGS. 15 and 16, binder material 160 is provided in an elongated strip wound on a roller 164. Binder material 160 is fed through fold-funnel 168 which folds it into a continuous elongated tube 172 which is drawn through the fold-funnel by roller 290. Seam 177 is supported by heavy foot or anvil 175 and is bonded by ultrasonic horn 179.

Loose-leaf mechanism 70 is fastened to the tube by rivets 184 or other means which clamp the tube closed.

Suitable pause in strip movement is provided so that circular die cuts 284 may be made in the sheet material between supply roller 164 and fold-funnel 168 to form finger grips 288 and 289 when the tube is cut on lines 186 to separate binders 188.

Although the present invention has been described with respect to details of certain embodiments thereof, it is not intended that such details be limitations upon the scope of the invention. It will be obvious to those skilled in the art that various modifications and substitutions may be made without departing from the spirit and scope of the invention as set forth in the following claims.

What is claimed is:

1. A loose-leaf binder comprising:

a single sheet of material comprising a first panel, a second panel folded over the first panel along a first fold line, a third panel folded over the first panel along a second fold line that is spaced normally from said first fold line, a device for temporarily holding sheets of paper, mounted over said second and third panels, first means for fastening extending from said device through the first, second and third panels fastening the second and third panels to the first panel under the device.

2. The loose-leaf binder of claim 1, further comprising:

second means for fastening the second and third panels to one another at a bond site that is spaced from the first and second fold lines and from the device, forming a pocket opening having overlap of said second panel and said third panel at said pocket opening.

3. The loose-leaf binder of claim 1 wherein:

said first fold line, said second fold line, said first panel, said second panel, said third panel, and said fastener means form a pocket having an opening extending to said first and said second fold lines.

4. A loose-leaf binder comprising:

a single sheet of material comprising a first panel, a second panel folded over the first panel along a first fold line, a third panel folded over the first panel along a second fold line spaced normally from said first fold line, a device for temporarily holding sheets of paper, mounted over said second and third panels, first means for fastening extending from said device so that it fastens the second and third panels to the first panel under the device, the second and third panels forming a pocket between them, said first means for fastening and said first panel.

5. The loose-leaf binder of claim 4, wherein said third panel extends from the second fold line over the first panel at least ⅓ the distance of the first panel between the first and second fold lines.

6. A method for making a loose-leaf binder comprising:

feeding a sheet of flat material through a folding funnel folding a second panel of the sheet on a first fold line and folding a third panel of the sheet toward said first panel on a second fold line that is parallel to and spaced normally from the first fold line forming a tube, mounting a device for temporarily holding sheets of paper, on said second panel and said third panel, extending fastening means from said device through said second panel, said third panel and said first panel to fasten the first, second, and third panels of the sheet of material together between the first and second fold lines by said fastening means so that the end of said second panel toward said third panel is spaced from the second fold line, and the end of said third panel toward said second panel is spaced from the first fold line, and a binder cover having first and second leafs, each leaf comprising said first panel, said second panel and said third panel, and at least one leaf comprising a pocket formed by the first, second, and third panels and said fastening means is formed.

7. The method of claim 6 further comprising:

configuring the first fold line so that the end of said second panel distal from the first fold line contacts the end of said third panel distal from the second fold line.

8. The method of claim 7, further comprising:

fastening said second panel to said third panel spaced from the fold lines and from the temporary paper holder forming a second pocket opening having overlap of said second panel and said third panel, lateral to the first pocket opening.

9. The loose-leaf binder of claim 3, further comprising:

second means for fastening the second and third panels to one another at a site that is spaced from each of said first fold line, said second fold line, and said first fastening means, forming a second opening to said pocket having one of said second panel and said third panel overlapping the other at said second opening.

10. A method for making a loose-leaf binder comprising:

feeding a sheet of flat material through a folding funnel forming a tube having an axial length, mounting a device for temporarily holding sheets of paper, on said tube so that the length of the device is normal to the axial length of said tube, extending fastening means from said device through said tube normal to said axial length between and spaced from a first end and a second end of said tube forming a binder cover having first and second leafs, each leaf comprising said tube, and a pocket comprising the walls of said tube and said fastening means.

11. The method of claim 10 wherein said tube is formed with a longitudinal open seam.

* * * * *